United States Patent [19]

Crockett et al.

[11] 4,311,978

[45] Jan. 19, 1982

[54] U-CORE PULSE TRANSFORMER

[75] Inventors: Charles R. Crockett, Arlington; Jerry W. Swafford, Dallas, both of Tex.

[73] Assignee: Teccor Electronics, Inc., Irving, Tex.

[21] Appl. No.: 44,475

[22] Filed: Jun. 1, 1979

[51] Int. Cl.[3] ..... H01F 27/04

[52] U.S. Cl. ..... 336/92; 336/192; 336/210

[58] Field of Search ..... 336/198, 208, 212, 192, 336/90, 92, 105, 107, 233, 210, 184

[56] References Cited

U.S. PATENT DOCUMENTS

| | | | |
|---|---|---|---|
| 1,457,784 | 6/1923 | Maurer | 336/92 |
| 1,763,114 | 6/1930 | Wermine | 336/208 X |
| 2,612,545 | 9/1952 | Gray | 336/233 X |
| 2,911,604 | 11/1959 | Krause | 336/90 |
| 2,988,715 | 6/1961 | Gizynski et al. | 336/92 X |
| 3,189,772 | 6/1965 | Wingler et al. | 336/198 X |
| 3,403,366 | 9/1968 | Klatle et al. | 336/107 X |
| 3,533,036 | 10/1970 | Wood | 336/208 X |

FOREIGN PATENT DOCUMENTS

| | | | |
|---|---|---|---|
| 2103112 | 8/1971 | Fed. Rep. of Germany | 336/198 |
| 2233005 | 5/1973 | Fed. Rep. of Germany | 336/198 |
| 2228222 | 1/1974 | Fed. Rep. of Germany | 336/192 |

*Primary Examiner*—Thomas J. Kozma

*Attorney, Agent, or Firm*—Hubbard, Thurman, Turner, Tucker & Glaser

[57] ABSTRACT

A pulse transformer having primary and secondary windings on separate insulating bobbins which are carried on the arms of a pair of U-shaped ferrite cores which provide a continuous magnetic path for coupling relatively high energy pulses. The bobbin and core assembly is assembled in and held together by a close fitting molded plastic housing which carries four pins to which the primary and secondary windings are attached. The connecting pins extend from a side of the housing which is open to receive the bobbin/core assembly and are adapted for printed circuit board mounting in which the board covers the housing opening so that the transformer is completely protected.

8 Claims, 1 Drawing Figure

U-CORE PULSE TRANSFORMER

BACKGROUND OF THE INVENTION

The present invention relates to pulse transformers and more particularly to pulse transformers for providing triggering signals to semiconductor controlled rectifying devices while isolating controlling circuitry from the high voltages being switched by the semiconductor controlled rectifying devices.

Semiconductor controlled rectifying devices (SCR's), both unidirectional and bidirectional, are presently used for power control in many consumer and commercial devices. For example light dimmers and motor speed controllers employ such devices. Such devices are also often used in place of mechanical relays for switching power off and on in other equipment such as microwave ovens where precise turn-on time is important and control of operating duty cycle is desired.

A problem encountered in many consumer devices which employ SCR's is the isolation of the power line voltages from the control circuitry. The SCR's are triggered into a conductive state by applying a small voltage or current between a trigger input and one of the two main power connections of the device. As a result the controlling device, unless isolated in some manner, must float at the power line voltage. In some situations, such as light dimmers, floating of the very simple control circuitry is acceptable since by proper packaging the control knob or switch itself can be isolated. In other applications where the control circuitry is more complicated it is very desirable, and in some cases required by building codes or other laws, that the low voltage control circuitry be isolated from the power line voltages.

Trigger transformers have been used for such isolation purposes. The commonly available trigger transformers have been either of the bar type or the toroid core type. In the slug type, a small cylindrical bar of magnetic material, such as iron or ferrite, has been used as a core about which primary and secondary windings have been quickly and easily wound. In such an arrangement, there is not a continuous magnetic path so that the power capacity of the device is lowered. In addition, the isolation between primary and secondary windings has been generally limited to the insulation on the transformer windings themselves. The toroid core devices on the other hand, provide a very efficient magnetic path but are extremely expensive to wind. The insulation between primary and secondary windings on the toroid core is also normally limited to that carried by the windings themselves.

Thus it can be seen that it would be desirable to provide a pulse trigger transformer having the high efficiency advantages of the toroid core transformer, the ease of winding of the slug type transformer, and, in addition, a very high voltage isolation between the primary and secondary windings.

SUMMARY OF THE INVENTION

Accordingly, an object of the present invention is to provide a pulse transformer in which a core has a continuous magnetic path.

Another object of the present invention is to provide a pulse transformer having very high voltage isolation between primary and secondary windings.

Yet another object of the present invention is to provide a pulse trigger transformer which is simple in construction and requires a minimum of labor to assemble.

These and other objects of the present invention are achieved by providing a pulse transformer comprising a pair of separate bobbins on which primary and secondary windings are wound and a pair of U-shaped ferrite cores having arms adapted for fitting within the bobbins to provide a continuous magnetic path for the transformer. In a preferred form, the bobbin and ferrite core assembly is frictionally held within a single piece molded housing having an internal cavity conforming closely to the outer dimensions of the bobbin and core assembly. In the preferred form, the plastic housing carries four pins which are electrically connected to the primary and secondary windings of the transformer and which provide means for both making electrical connections to the transformer and for mechanically mounting the transformer to a printed circuit board.

DESCRIPTION OF THE PREFERRED EMBODIMENTS

Figure 1:
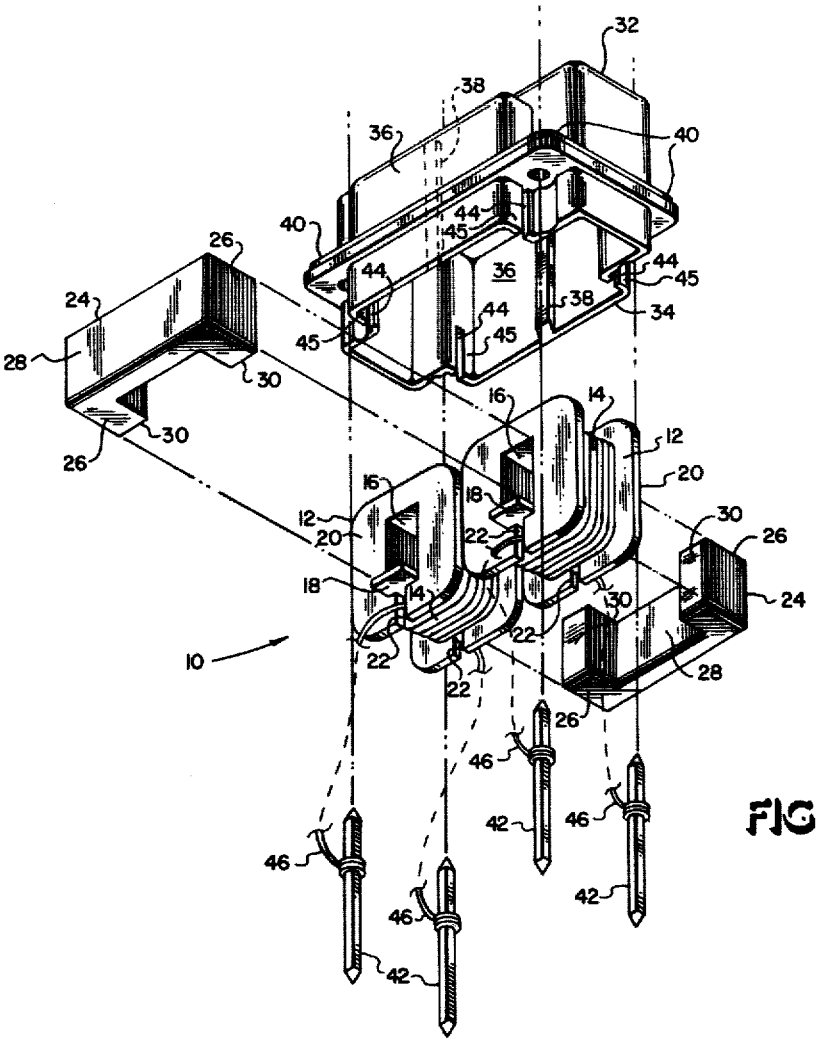

With reference now to FIG. 1, there is provided an exploded view of a pulse transformer, shown generally at 10, according to the present invention. The transformer includes a pair of bobbins 12 formed from a dielectric material and preferably identical although they may be marked with indicia indicating a number of turns and directions of winding as required for the particular application. Each of the bobbins 12 carries a winding 14 either of which may be the primary or the secondary. In the preferred form, bobbins 12 are generally rectangular shaped and each has a rectangular aperture 16 passing through the windings 14. Wings or shelves 18 preferrably extend from both sides of the bobbins 12 and form an extension of the lower inner surfaces of apertures 16. The function of the wings 18 will be explained in more detail below. Slots 22 are provided in the sides 20 of bobbins 12 below the wings 18. These slots 22 are used to guide the ends of each of the windings 14 into or from the bobbins 12.

A pair of ferrite cores 24 are generally U-shaped having arm portions 26 and bight portions 28. The arms 26 are of rectangular cross sections selected to fit loosely within the apertures 16 in bobbins 12. In addition the length of arms 26 is at least one half of the overall length of apertures 16 so that, upon insertion of the cores 24 into bobbins 12, firm contact can be made between faces 30 of the cores 24. When the U-shaped cores 24 are inserted into the bobbins 12, they provide a continuous magnetic path coupling the windings 14 together efficiently so that relatively high energy pulses equivalent to those which may be coupled by toroid core transformers may be coupled from primary to secondary.

In the preferred embodiment, the assembly comprising bobbins 12 with windings 14 and U-Cores 24 is assembled and packaged in a one piece molded plastic housing 32. Housing 32 has an internal cavity conforming to the outer dimensions of the core and bobbin assembly. A lower side 34 of housing 32 is open so that the core and bobbin assembly may be inserted into the housing where it is held in place by a friction fit. Outer walls 36 of housing 32 carry internal raised ridges 38 which contact the U-shaped cores 24 at the center of bight portions 28 upon assembly to apply pressure which holds the faces 30 of the cores together. Flanges 40 are carried on four corners of housing 32 and each has a hole for carrying a pin 42 in a press fit arrangement. Four slits 44 are provided in walls 45 of housing 32 below the flanges 40. The slits 44 provide a path for connection of the ends 46 of windings 14 to the pins 42. As indicated in the exploded view the pins 42 are pressed into the flanges 40 from below. Flanges 40 are spaced above the lower edge 34 of housing 32 to provide space for the soldered connection of leads 46 to pins 42. In the preferred embodiment none of the wrapped wire or solder is present on that portion of pin 42 which extends below side 34 of housing 32 when the assembled transformer 10 is inserted into a printed circuit board. In addition upon flow soldering, the junction of leads 46 with pins 42 is spaced from the board surface to avoid reflowing of the solder junction.

Figure 2:
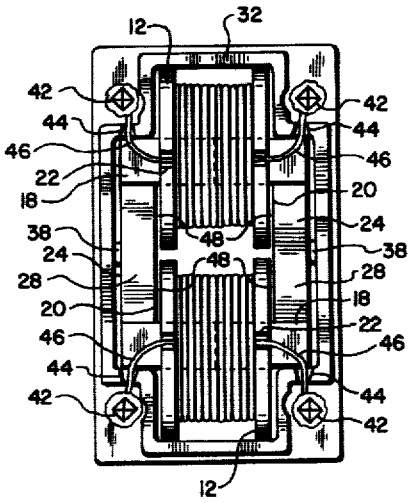

With reference now to FIG. 2 details of an assembled transformer are illustrated in a bottom view. All parts carry the same designation numbers used in the other figures. In particular, the fit of the cores 24 within bobbins 12 and of the core and bobbin assembly into the housing 32 is well illustrated. In addition the routing of ends 46 of windings 14 through slits 22 in the bobbins 12 and slits 44 in the housing 32 is also better illustrated. Between slits 22 and slits 44 the leads 46 pass over the wings 18 extending from bobbins 12. The wings 18 provide high voltage isolation between the leads 46 and the ferrite cores 24 which are fairly good electrical conductors. The contact of ridges 38 with cores 24 is clearly seen in this view. Small gaps 48 are also shown between sides 20 of bobbins 12 and bight portions 28 of cores 24. The gaps 48 result from the length of arms 26 of cores 24 being greater than the length of apertures 16. Gaps 48 insure that forces applied to cores 24 by housing 32 hold the faces 30 of the cores tightly together for best coupling.

Figure 3:
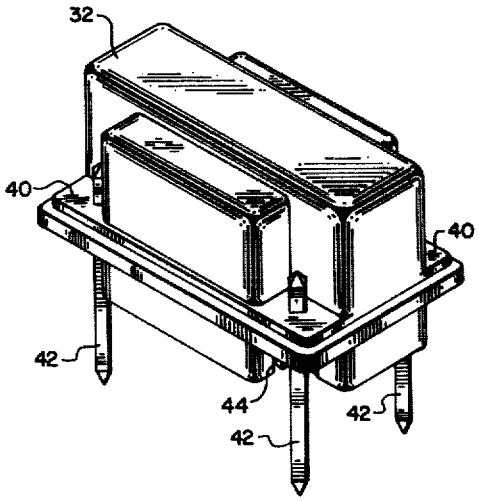

With reference now to FIG. 3, more details of the assembled pulse transformer are shown in a generally top perspective view. The various parts visible in this view again carry the same designation numbers as in the other figures.

The pulse transformer illustrated in the Figures is quite small and well adapted for assembly on printed circuit boards with solid state and micro-electronic devices. In particular, in the preferred embodiment, housing 32 has outer dimensions of approximately 0.8 inches long, 0.4 inches wide, and 0.5 inches high. The pins 42 are cut from square cross section stock having a side dimension of 0.025 inches and an overall length of about 0.5 inch of which approximately half extends below the base of the package. In the preferred form, the pins 42 are positioned at the corners of a rectangle having sides of 0.3 inch by 0.6 inch and therefore conform to a standard one-tenth inch grid pattern.

The method of assembly of a transformer according to the present invention is well illustrated by FIG. 1. The windings may be placed on bobbins 12 in a number of ways, such as winding by hand, but bobbins 12 are well suited to automated winding. Bobbins 12 are preferrably mounted on a rotating shaft having a rotation counter for stopping after a preselected number of turns. One end of a winding is then placed through a slot 22 and the bobbin is rotated the preselected number of times. The second end of the winding is then placed in the second slot 22 and cut to a desired length. Protective tape may be placed around the winding to further protect it if desired.

When a pair of bobbins have been prepared they are assembled with a pair of cores 24 as illustrated in the drawings. A housing 32 is then prepared by pressing pins 42 into flanges 40. In the preferred assembly method the pins 42 are inserted only part way into flanges 40 prior to connection of leads 46. The bobbin/-core assembly is then pressed into housing 32, with the primary frictional contact being between cores 24 and ridges 38. The ends 46 of windings 14 are then threaded through slots 44 and wrapped around pins 42 slightly below the side 34 of housing 32. The wrapped ends 46 are then soldered to the pins 42. The pins 42 are then pressed further into and through flanges 40 so that the wrapped and soldered portion is above the side 34 of housing 32.

After the transformer is assembled it may be mounted on printed circuit boards in a conventional manner. The flanges 40 and pins 42 are quite substantial when compared to the small size of the pulse transformer 10 and provide very good mechanical support of the assembly on a printed circuit board when all four pins 42 are properly soldered.

One embodiment of the present invention comprises a transformer as described above in which each winding 14 is formed from sixty-six turns of thirty-four gauge copper wire. The primary of this transformer has a maximum DC resistance of 2 ohms and a minimum inductance of 2 millihenries. The transformer can couple a minimum 200 volt-microsecond pulse.

While the present invention has been illustrated and described with reference to a particular apparatus it is apparent that various modifications and changes can be made within the scope of the present invention as defined by the appended claims.

I claim:

1. A pulse transformer comprising:

first and second bobbins carrying primary and secondary windings respectively, first and second U-shaped ferrite cores, each having two arms connected by a bight portion, the arms of said first and second cores carried within central apertures through said bobbins with each arm being in physical contact with a corresponding arm of the opposite core and the bight portions of said cores being adjacent ends of said bobbins, wherein said bobbins and ferrite cores are carried within a one-piece molded plastic housing having an internal cavity conforming substantially to the outer dimensions of the assembly comprising said first and second bobbins and said first and second cores, said housing being open on one side to allow insertion of said assembly, and four pins carried on the outer surface of said plastic housing with one each of said pins connected to ends of said primary and secondary windings.

2. A pulse transformer according to claim 1 wherein said pins extend from said one side of said housing in parallel relationship to each other, said housing has slits adjacent the ends of said bobbins, and said ends of said primary and secondary windings are carried within said slits.

3. A pulse transformer according to claim 1 further including four flanges carried on corners of said housing for supporting said pins.

4. A pulse transformer according to claim 3 wherein said pins are carried on said housing by means of negative tolerance holes in said flanges into which said pins are pressed.

5. A pulse transformer according to claim 3 wherein said flanges are spaced from said one side and said ends of said primary and secondary windings are connected to said pins between said flanges and said one side.

6. A pulse transformer according to claim 1 further including internal raised ridges adjacent the bight portions of said U-shaped cores, said ridges adapted to provide substantially all frictional engagement between said housing and said cores to thereby hold said cores together.

7. A pulse transformer according to claim 1 wherein said bobbins have at least one slit in a side wall extending from an outer edge to a point adjacent said central aperture, said slit adapted for carrying an end of said windings, and further including at least one wing extending from said bobbin at the end of said slit adjacent said aperture, said wing adapted for electrically isolating an end of said windings from said ferrite cores.

8. A pulse transformer according to claim 7 wherein the length of said wing is about equal to the thickness of the bight portion of said ferrite cores.

* * * * *